US010842295B2

(12) United States Patent
Didur

(10) Patent No.: US 10,842,295 B2
(45) Date of Patent: Nov. 24, 2020

(54) ULTRAVIOLET AND WHITE LIGHT SHOWCASE

(71) Applicant: FINESSE DIAMOND, CORP, New York, NY (US)

(72) Inventor: David F. Didur, Toronto (CA)

(73) Assignee: FINESSE DIAMOND CORP., New York, NY (US)

( * ) Notice: Subject to any disclaimer, the term of this patent is extended or adjusted under 35 U.S.C. 154(b) by 0 days.

(21) Appl. No.: 15/636,878

(22) Filed: Jun. 29, 2017

(65) Prior Publication Data

US 2019/0000242 A1 Jan. 3, 2019

(51) Int. Cl.

| | |
|---|---|
| ***A47F 3/00*** | (2006.01) |
| ***A47F 11/10*** | (2006.01) |
| ***A47F 3/04*** | (2006.01) |
| ***F21S 10/02*** | (2006.01) |
| ***F21V 23/00*** | (2015.01) |
| ***F21V 9/30*** | (2018.01) |
| ***F21V 5/04*** | (2006.01) |

(Continued)

(52) U.S. Cl.

CPC ..... *A47F 3/001* (2013.01); *A47F 3/005* (2013.01); *A47F 3/0404* (2013.01); *A47F 11/10* (2013.01); *F21S 10/02* (2013.01); *F21V 5/04* (2013.01); *F21V 9/30* (2018.02); *F21V 23/009* (2013.01); *F21V 23/0435* (2013.01); *A47F 7/02* (2013.01); *F21V 21/14* (2013.01); *F21W 2131/30* (2013.01); *F21W 2131/405* (2013.01); *F21Y 2113/13* (2016.08); *F21Y 2115/10* (2016.08)

(58) Field of Classification Search

CPC ..... A47F 3/001; A47F 3/0404; A47F 3/005; A47F 11/06–10; F21W 2131/301; F21W 2131/10; F21W 2131/13; F21W 2131/00

See application file for complete search history.

(56) References Cited

U.S. PATENT DOCUMENTS

| | | | | |
|---|---|---|---|---|
| 5,388,357 A | 2/1995 | Malita | | |
| 7,325,940 B2 * | 2/2008 | Cea | A45C 11/16 | 206/566 |

(Continued)

OTHER PUBLICATIONS

Sep. 19, 2018—(WO) International Search Report—App PCT/US2018/039891.

(Continued)

*Primary Examiner* — Bryon T Gyllstrom
*Assistant Examiner* — Eric T Eide
(74) *Attorney, Agent, or Firm* — Banner & Witcoff, Ltd.

(57) ABSTRACT

A showcase is provided for displaying items, at least one of which is an ultraviolet-reactive item. The showcase has a showcase structure for containing the items to be displayed, which includes at least one glazed surface through which the items can be seen. Showcase lighting is provided wired with the showcase structure. The showcase lighting includes: at least one compact ultraviolet LED assembly; a white light assembly; and a controller for controlling the ultraviolet LED assembly and white light assembly with modulation such that the ultraviolet radiation stimulates visible fluorescence in the ultraviolet-reactive item while items in the showcase structure are broadly illuminated by the white light. A method for displaying items in a showcase, and a kit for retrofitting existing showcases is also provided.

19 Claims, 7 Drawing Sheets

(51) Int. Cl.

| | |
|---|---|
| ***F21V 23/04*** | (2006.01) |
| *F21W 131/405* | (2006.01) |
| *F21W 131/30* | (2006.01) |
| *F21Y 115/10* | (2016.01) |
| *F21Y 113/13* | (2016.01) |
| *A47F 7/02* | (2006.01) |
| *F21V 21/14* | (2006.01) |

(56) References Cited

U.S. PATENT DOCUMENTS

| | | | | |
|---|---|---|---|---|
| 7,661,862 | B2 | 2/2010 | Lee et al. | |
| 7,959,320 | B2 | 6/2011 | Mueller et al. | |
| 8,508,126 | B1 * | 8/2013 | Morejon | F21V 9/30 313/506 |
| 9,546,777 | B2 | 1/2017 | Didur | |
| 2004/0141320 | A1 * | 7/2004 | Bock | G01N 21/87 362/253 |
| 2007/0115658 | A1 * | 5/2007 | Mueller | A45D 42/10 362/231 |
| 2012/0146519 | A1 | 6/2012 | Briggs | |
| 2014/0307444 | A1 * | 10/2014 | Gorlinskiy | F21V 5/002 362/294 |

OTHER PUBLICATIONS

Sep. 19, 2018—(WO) Written Opinion of the International Searching Authority—App PCT/US2018/039891.

* cited by examiner

ULTRAVIOLET AND WHITE LIGHT SHOWCASE

FIELD OF THE INVENTION

The invention relates to showcases for displaying items, and more particularly relates to lighting and effects systems for such showcases.

BACKGROUND

An interesting property of ultraviolet radiation is its ability to stimulate the phosphors of certain reactive materials and substances so as to produce a visually striking effect through the fluorescence of the material or substance.

The existence of phosphors in certain gemstones (e.g. diamonds) has been known to jewellers and gemologists for many years. In the case of diamonds, phosphors may be present in the form of impurity atoms of nitrogen, hydrogen and boron. These phosphors are largely undetectable in natural light conditions. However, under ultraviolet light, the phosphors may fluoresce in shades of orange, blue, yellow or green. Fluorescence refers to the property of a substance to emit light through absorbed UV radiation, while exposed to the source of the UV radiation. The Gemological Institute of America has estimated that approximately 25% to 35% of diamonds have some degree of fluorescence. Diamonds containing phosphors in different concentrations may be virtually indistinguishable from each other in natural light, but become differentially fluoresced when exposed to ultraviolet radiation. The fluorescence appears as the emitting of lumens directly from the gemstone.

When present in strong concentrations, the presence of these phosphors has been associated with flawed or lower quality stones. Thus, fluorescence has been used as a grading and descriptive tool by jewellers and gemologists. Ultraviolet inspection lights are typically used under laboratory conditions where outside light is blocked out. Such ultraviolet lights are not used in the presence of customers or in a store setting with typically bright ambient lighting. Further, the perceived negative value of the fluorescent stones has meant that jewellers have sought to hide this feature from, or deemphasize it, to customers. Stones with Medium Blue or Strong Blue or Very Strong Blue fluorescence grades trade at very significant discounts.

This effect has not been used in a display context where the phosphor containing properties of items were particularly highlighted or promoted.

A showcase is typically a glazed case or box, or cabinet for displaying and protecting items. It may be used in various contexts in a permanent or temporary installation to exhibit items (or a single item) in a particularly attractive or favorable aspect. Frequently, showcases are used to display items of particular high value or rarity to enable the items to be examined more closely.

However, showcases have not been used to display the fluorescent properties of ultraviolet-reactive materials because it has been thought that such materials needed to be examined in low light or preferably complete darkness in order for the ultraviolet radiation to have visible effect.

SUMMARY OF THE INVENTION

The applicant has discovered that in fact ultraviolet radiation and white light can be used together without substantially compromising the ability to stimulate visible fluorescence of an ultraviolet-reactive item. This allows for a new experience for observers (e.g. prospective purchasers). By effect of the ultraviolet radiation, even in the presence of white light, the ultraviolet-reactive item can appear to spontaneously "pop" to the observer's attention.

According to a first aspect, the invention provides a showcase for displaying items, at least one of which is an ultraviolet-reactive item. A showcase structure contains the items to be displayed. The structure includes at least one glazed surface through which the items can be seen. Showcase lighting is provided which is wired with the showcase structure. This includes at least one compact ultraviolet LED assembly having a housing, within which is disposed an LED circuit, a 365 nm ultraviolet LED diode disposed on the LED circuit, and an optical collimator having a parabolic lens to focus the emitted ultraviolet radiation. This also includes a white light assembly capable of outputting white light in a range of colour temperature from 2800K to 5500K. A controller is provided for controlling the ultraviolet LED assembly and white light assembly with modulation such that the ultraviolet LED stimulates visible fluorescence in the ultraviolet-reactive item while items in the showcase structure are broadly illuminated by the white light.

Preferably, the housing of the at least one ultraviolet LED assembly is directionable toward at least one ultraviolet-reactive item. For example, the housings of multiple ultraviolet LED assemblies may be differently directionable, so as to either converge their respective emitted LED radiation toward a single ultraviolet-reactive item, or to be directed toward separate ultraviolet-reactive items.

Preferably, at least part of the showcase lighting is hidden within the showcase structure. The showcase structure may include display mountings disposed therein. In this case, the housing of the at least one ultraviolet LED assembly may be directionable toward an ultraviolet-reactive item on at least one of the mountings. Preferably, the ultraviolet radiation is collimated so as to hit the ultraviolet-reactive item substantially without hitting the at least one mounting.

In one embodiment, the showcase lighting may be wired through a channel in the showcase structure ("channel" in this case just meaning any type of recess, corner, inlet/outlet, or any physical feature that accommodates one or more wires). The lighting wiring may be modularly installable/removable in certain embodiments. In certain embodiments, the ultraviolet LED assembly and the white light assembly are wired on a common circuit.

The controller may be programmable to selectively modulate power output of the ultraviolet LED assembly and the white light assembly. For example, to power the ultraviolet LED assembly and the white light assembly on a timed or intermittent basis, or on a patterned basis.

Various wiring designs (and fixture designs) for the assemblies are possible. In certain embodiments, at least one of the assemblies may be on a pendant.

Preferably, the collimator focusses the emitted ultraviolet radiation to a less than 15 degree spread. More preferably, the collimator focusses the emitted ultraviolet radiation to an 8-10 degree spread.

Various designs and configurations of the showcase structure are possible. In certain embodiments, the showcase structure may have a door or window or gate through which items can be inserted and positioned. For example, this may allow them to be specifically positioned in the path of the ultraviolet radiation of one or more of the ultraviolet LED assemblies.

According to a second aspect, a method is provided for displaying items in a showcase. A showcase structure is provided including at least one glazed surface through which the items can be seen. Showcase lighting is provided by wiring the showcase lighting with the showcase structure. The showcase lighting includes at least one compact ultraviolet LED assembly having a housing, within which is disposed an LED circuit, a 365 nm ultraviolet LED diode disposed on the LED circuit, and an optical collimator having a parabolic lens to focus the emitted ultraviolet radiation. The showcase lighting also includes a white light assembly capable of outputting white light in a range of colour temperature from 2800K to 5500K. A controller is provided for controlling the ultraviolet LED assembly and white light assembly with modulation. Items to be displayed are inserted in the showcase structure. At least one of the items is an ultraviolet-reactive item. The ultraviolet-reactive item may be positioned such that it is in a path of the emitted ultraviolet radiation of the ultraviolet LED assembly. Alternatively, the housing of the ultraviolet LED assembly may be directed such that its emitted ultraviolet radiation is directed toward the ultraviolet-reactive item. The ultraviolet LED stimulates visible fluorescence in the ultraviolet-reactive item while items in the showcase structure are broadly illuminated by the white light.

According to a third aspect, a kit is provided for retrofitting a showcase to display both ultraviolet-reactive and non-ultraviolet reactive items. The showcase has a showcase structure that includes at least one glazed surface through which the items can be seen. The kit includes an assembly for wiring into the showcase structure. The assembly includes at least one compact ultraviolet LED assembly having a housing mountable on or in the showcase structure, within which is disposed an LED circuit, a 365 nm ultraviolet LED diode disposed on the LED circuit, and an optical collimator having a parabolic lens to focus the emitted ultraviolet radiation. The assembly also includes a white light assembly mountable on or in the showcase structure and capable of outputting white light in a range of colour temperature from 2800K to 5500K. The assembly also includes a controller in communication with the ultraviolet LED assembly and the white light assembly for controlling the ultraviolet LED assembly and white light assembly with modulation. By assembling the kit for use with a showcase structure, the ultraviolet LED can stimulate visible fluorescence in the ultraviolet-reactive item while all items in the showcase structure, both ultraviolet-reactive and non-ultraviolet reactive, are broadly illuminated by the white light.

DETAILED DESCRIPTION

The present showcase operates to display the fluorescence of an ultraviolet-reactive item (having man-made or naturally occurring phosphors) while also (simultaneously) lighting items with white light in a conventional sense. The showcase itself can be a purpose-built or custom structure having fully integrated wiring of a UV LED assembly and white light assembly.

Items that exhibit fluorescence under ultraviolet radiation include ultraviolet-sensitive gems, minerals, and even animals (e.g. fish), as well as, man-made items manufactured or coated with phosphoric chemicals, paints or dyes (e.g. candy/confections, toys, cosmetics, decorative accents on various products, display devices, labels, signage, and decorative items in regard to household and/or commercial display).

Figure 11:
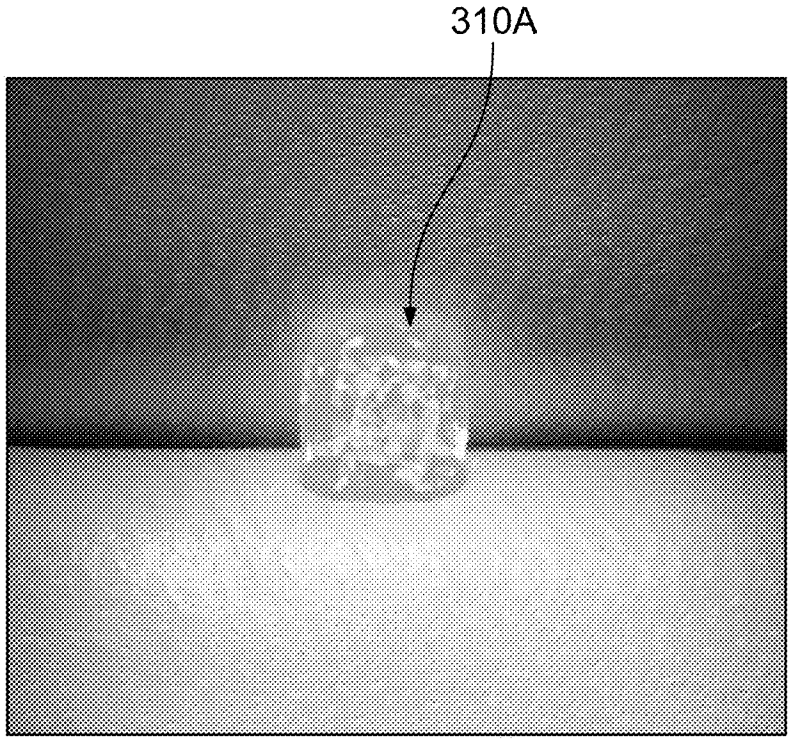
FIG. 11 is a photographic view of a sample item (here, diamond) under influence of UV radiation (modulated white light).
Figure 10:
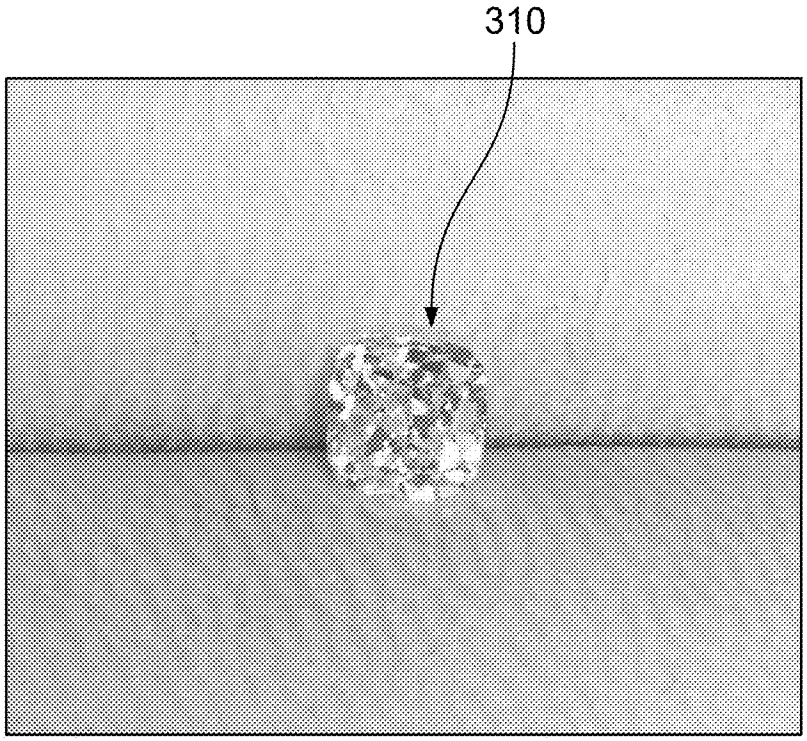
FIG. 10 is a photographic view of a sample item (here, diamond) in white light only.

One example of such an item 310 is shown in FIGS. 10 and 11. The item (here, a diamond having naturally occurring phosphors) is shown in white light only (FIG. 10) and with UV radiation (FIG. 11). The diamond presents itself in a unique and striking form. While under the effect of the ultraviolet radiation, the gem itself emits visible illumination through its fluorescence. When the radiation source is shut off, the effect ceases.

Conventionally, it was thought that the atmospheric surroundings of the item needed to be quite dim or, preferably, fully dark in order to glimpse such radiated effects. In fact, even in the applicant's prior related invention, a Gemstone Display Box, described in U.S. Pat. No. 9,546,777 (incorporated herein by reference), it was considered that the box needed to prevent some ambient light, and the UV LED needed to be very close to the gemstone in order for fluorescent "pop" effects to be witnessed. Surprisingly, the applicant has determined that through narrowly collimated focussed and high powered UV LED, the effects can still be spectacular even when the LED is at some distance from the ultraviolet-reactive item, and in the presence of ambient (and here enhanced white) light.

Lighting is provided in conventional showcases. But in this case both (visible) white light and (invisible) ultraviolet radiation are provided in concert in a showcase (or retrofit kit for a showcase). Modulation is used to balance power to both sources.

Figure 4:
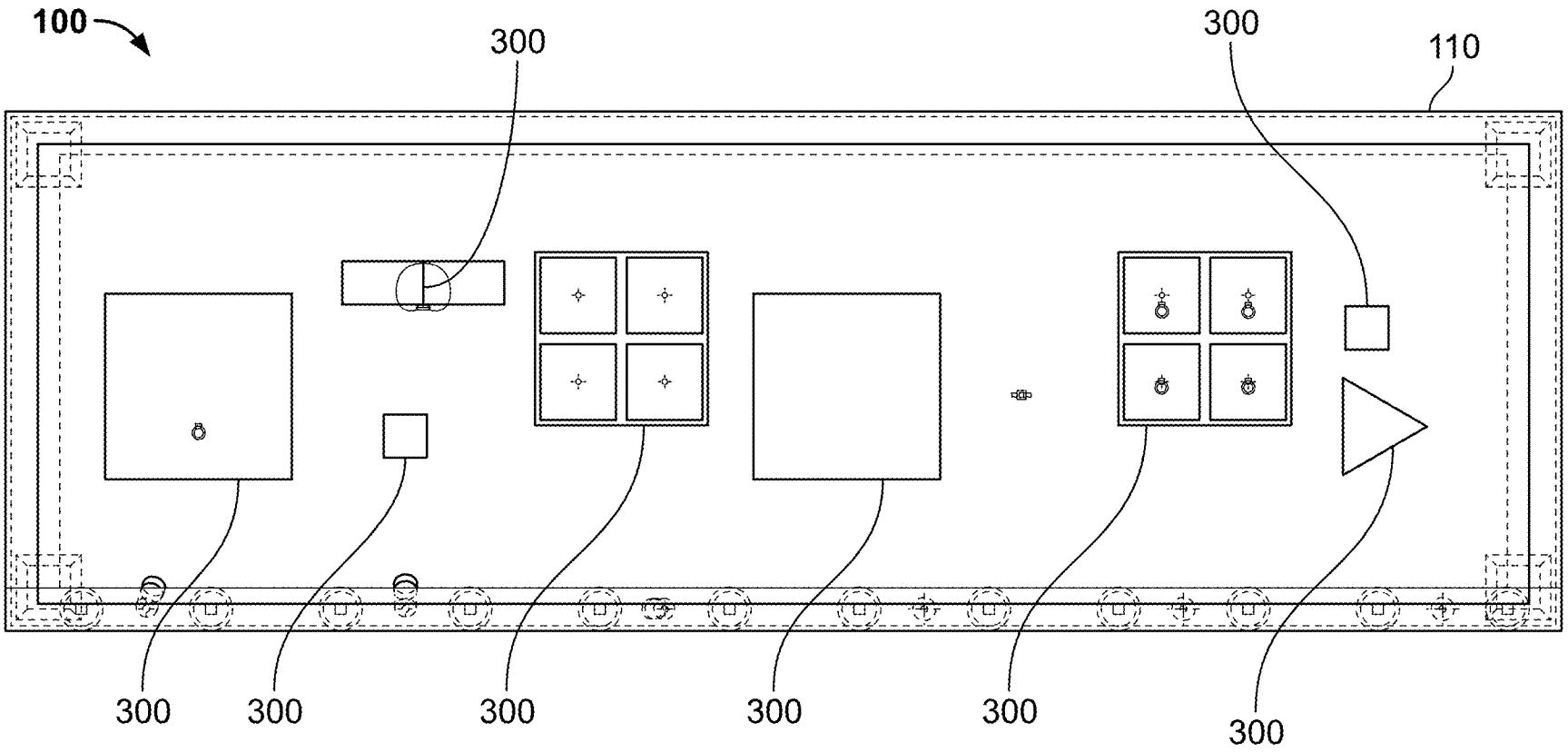
FIG. 4 is a top view of a showcase in which showcase lighting of the present invention may be used.
Figure 7:
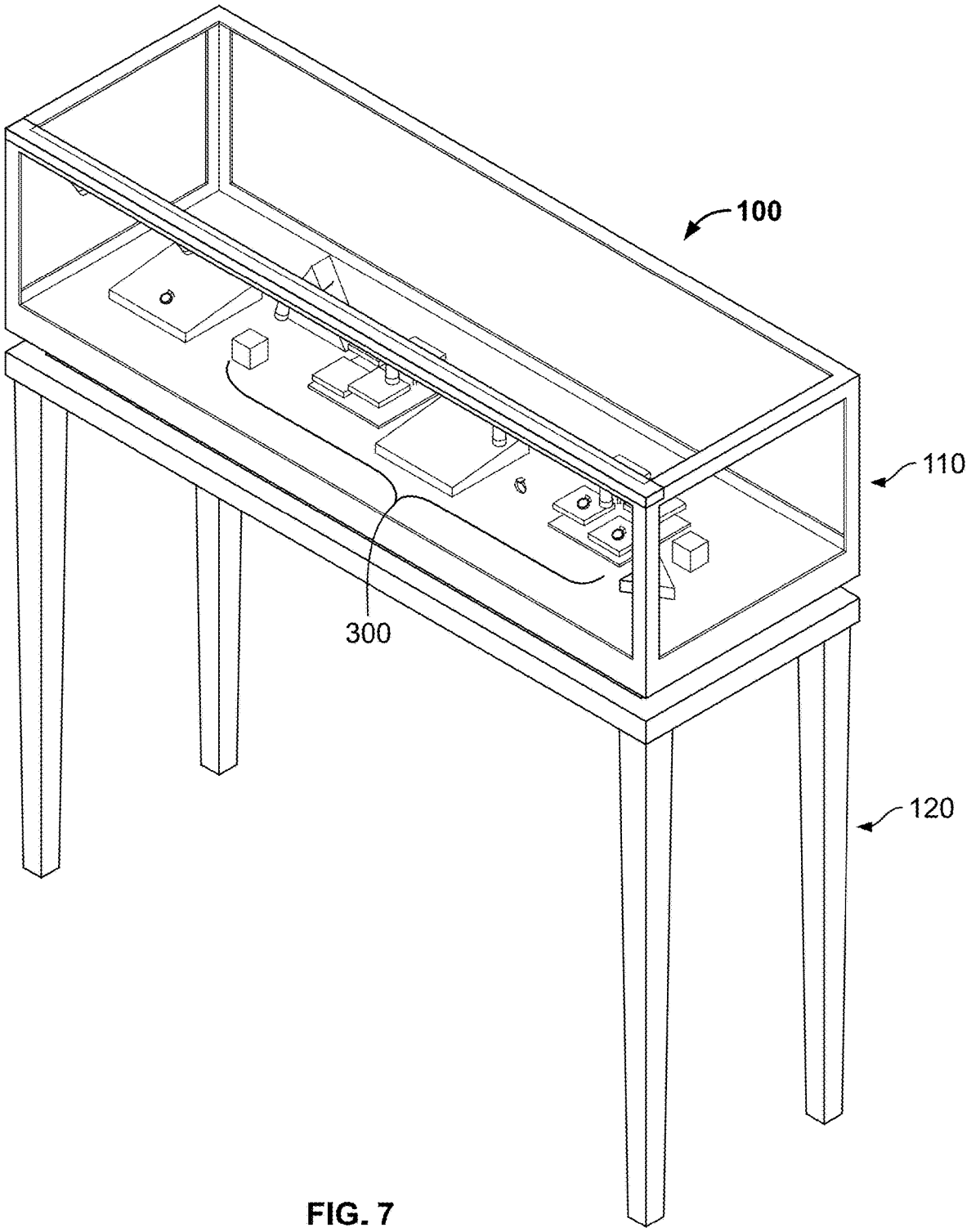
FIG. 7 is a perspective view of the showcase.
Figure 8:
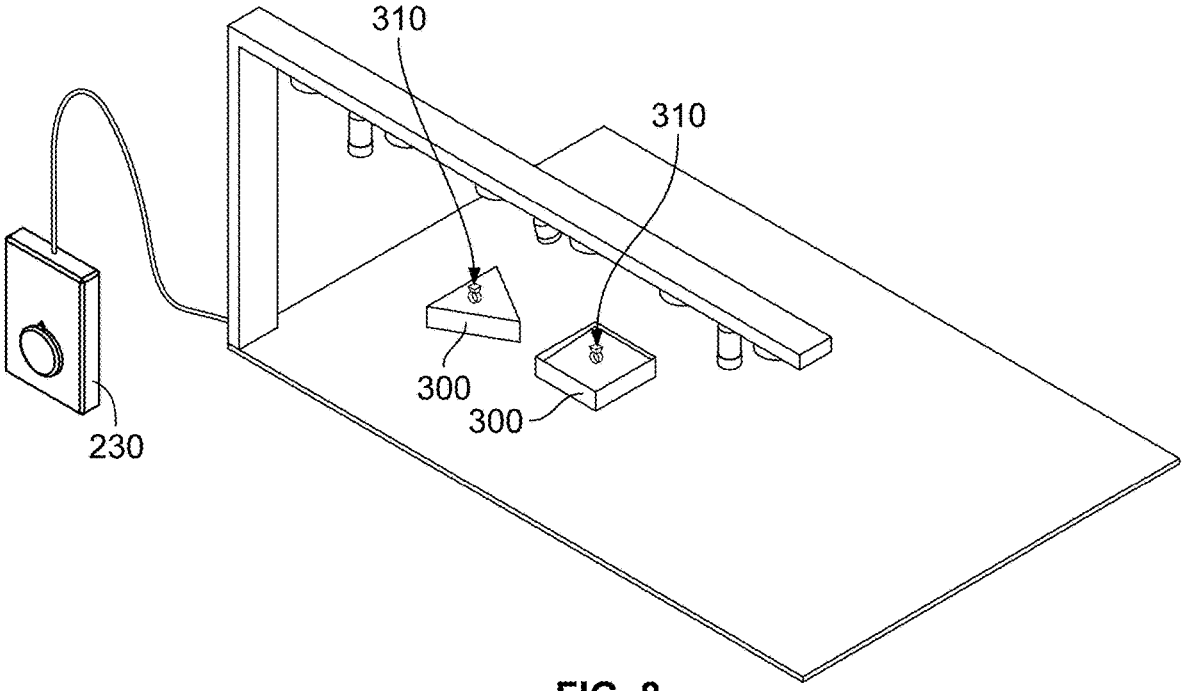
FIG. 8 is a simplified perspective view showing the showcase lighting with items (full showcase not shown).

A basic showcase 100 is shown in FIG. 7 (and from the top view in FIG. 4). The showcase includes a base 120 (here, shown having legs) and a case or cabinet 110. Inside the case are items. Although a conventional configuration is shown in FIG. 7, it will be appreciated that any type of showcase structure can be used for the present invention—with or without a base; freestanding or built into another structure; and having any shape, dimension, number of walls or edges, so long as there is at least one surface having glazing (glass, plastic, etc.) through which the items can be seen. The showcase may contain internal mountings 300 on which the items can be placed or presented or staged. Such mountings can include any type of risers, shelves, boxes, platforms, displays, holders, etc., whether removable or fixed. Any type of door or gate or access window (not shown) may also be provided for insertion/removal of items and positioning the items.

Figure 1:
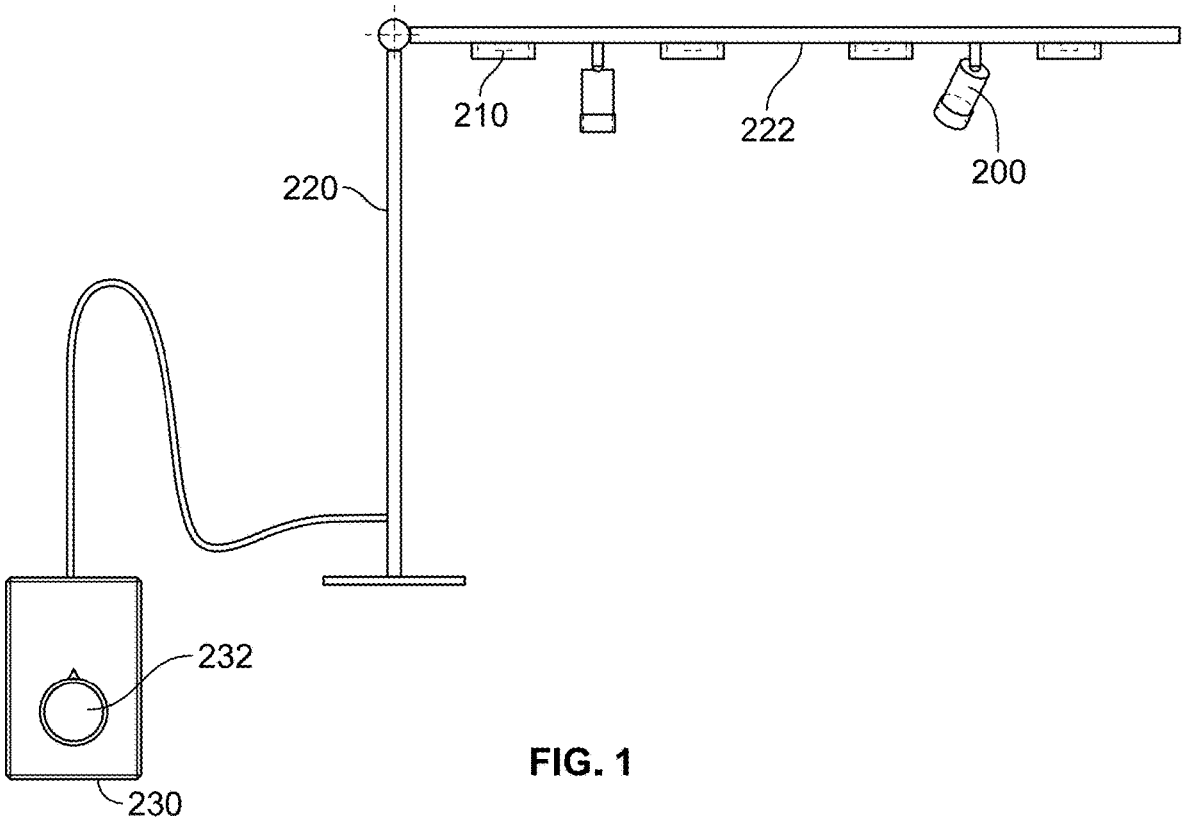
FIG. 1 is a front view of an embodiment of a kit for retrofitting a showcase to display both ultraviolet-reactive and non-ultraviolet reactive items.
Figure 2:
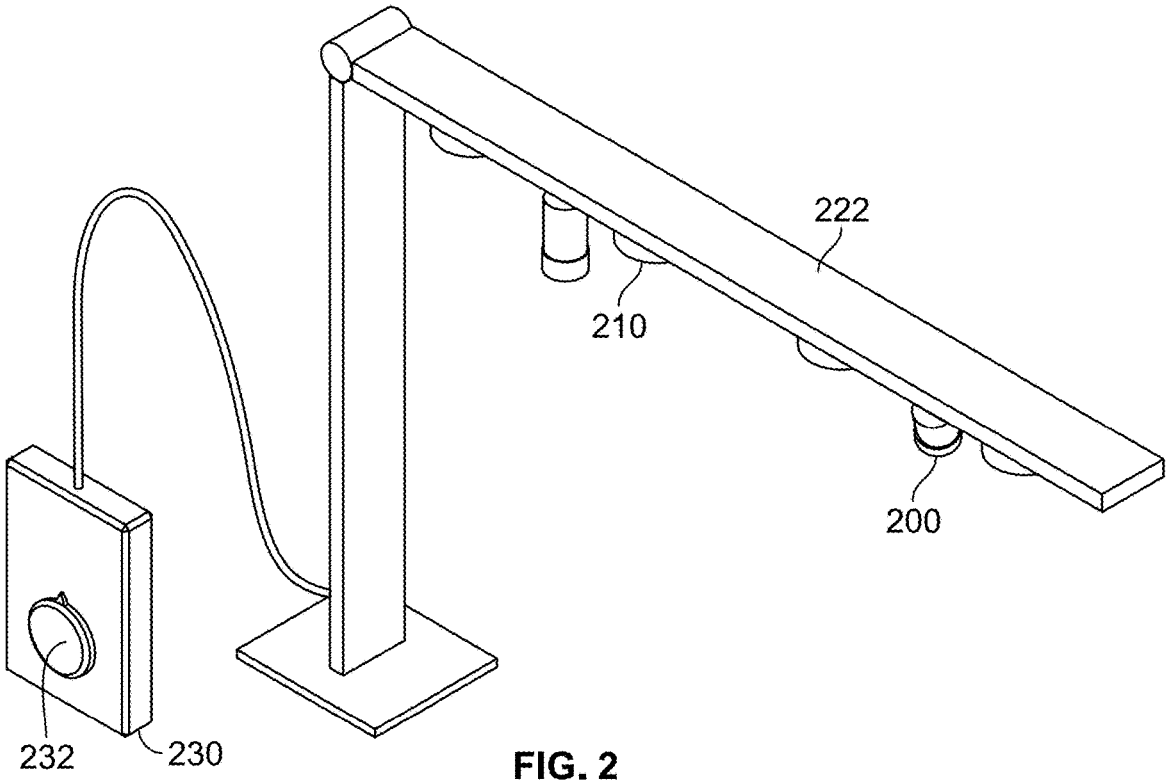
FIG. 2 is a perspective view of the kit.

Turning to FIGS. 1 and 2, showcase lighting is provided (here, shown as a separate unit or kit having its own standing structure 220 and mounting 222). The showcase lighting includes white light bulb or diode assemblies 210 and ultraviolet LED assemblies 200. A controller 230 is provided that is wired with both the white light and UV LED assemblies. The controller includes at least one control 232 (here, shown very simplified).

The controller operates to modulate lumen intensity (relative "dimness" or "brightness") of both the ultraviolet and white light assemblies, in order to optimize mix of light to best illustrate an item. The controller allows versatility for various lighting scenarios.

The structure of the controller can include various programmable user controls, such as dials, sliders, etc.

Sample enhanced functions of the controller may include user preprogrammed combinations of light. For example, special theatrical shimmer or magical effects can be produced, and other specific lighting patterns or "scenes". Further, timing effects (e.g. turn-on/shut-off timing) can be programmed in certain embodiments.

It will be appreciated that the showcase lighting may also be wired directly into the structure or millwork of the showcase as a fixture (e.g. though defined channels, conduits or raceways in the showcase). The controller may be positioned in direct wired communication with the showcase lighting, or it may be configured as a remote device, or even as an app that controls the showcase lighting remotely.

The white light bulb or diode 210 can be any type of white light in the colour temperature range of 2800K to 5500K. The white light source can be LED, incandescent, halogen, xenon, etc.

Figure 3A:
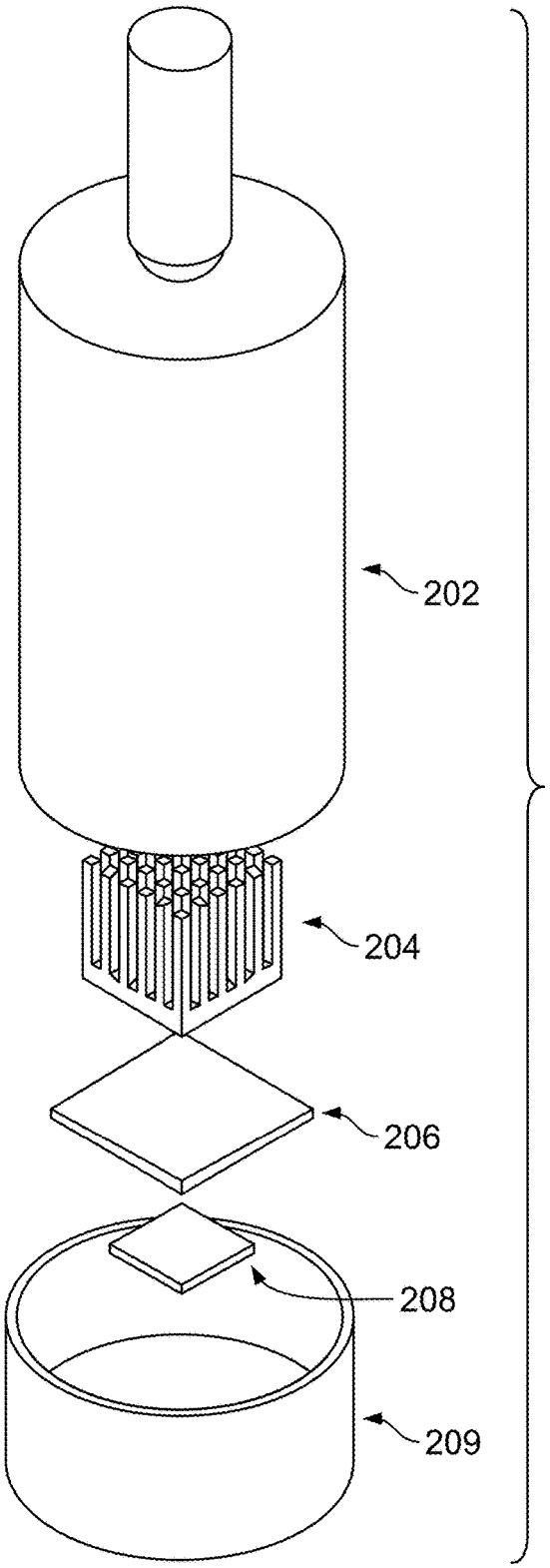
FIG. 3A is a perspective exploded view of a UV LED assembly.
Figure 3B:
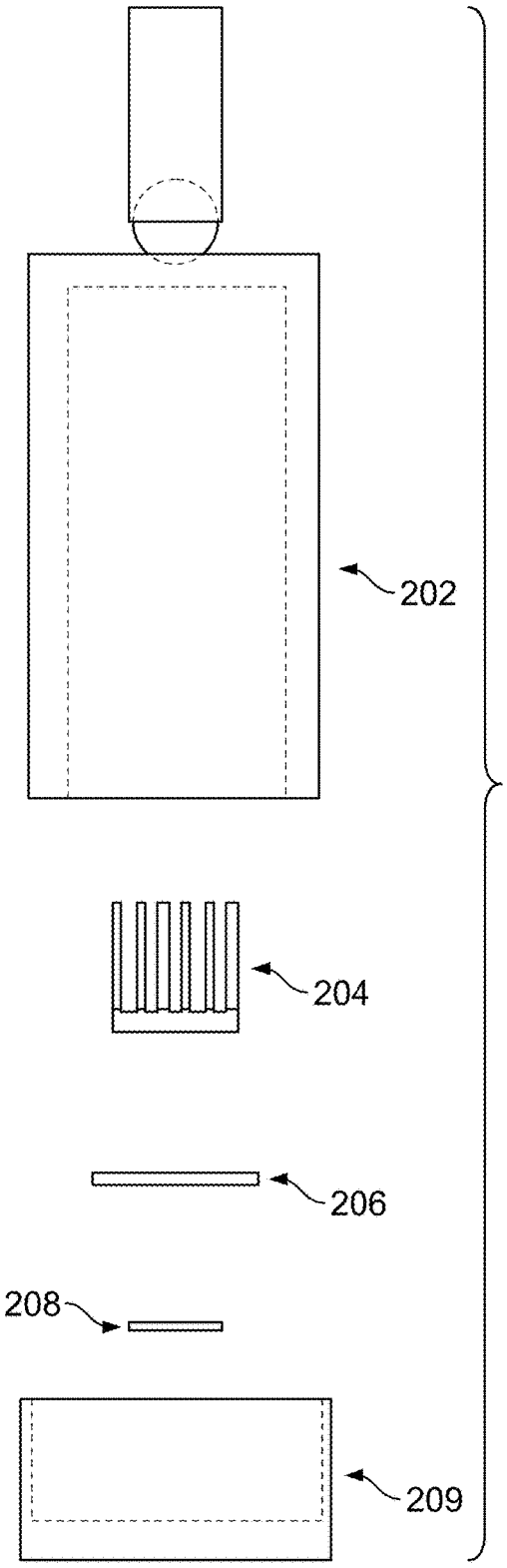
FIG. 3B is a front exploded view of a UV LED assembly.

The source of ultraviolet radiation is preferably a UV LED having the specific wavelength of 365 nm. The LED assembly 200 is illustrated in exploded views in FIGS. 3A and 3B. The LED assembly includes an LED circuit 206. This circuit 206 includes a light-emitting diode 208 for emitting ultraviolet radiation, most preferably at the specific ultraviolet wavelength of 365 nanometers (nm). The diode is a high-powered diode at 3 watts.

Figure 6:
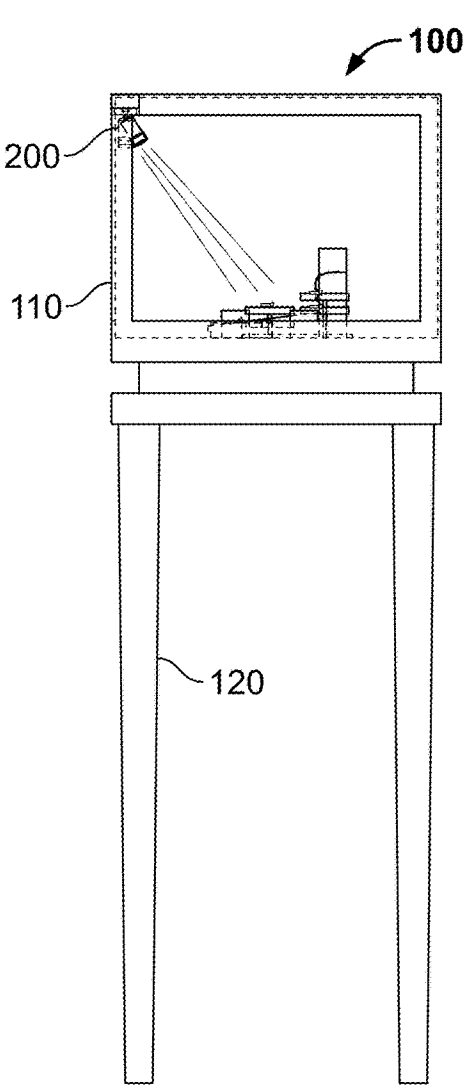
FIG. 6 is an end view of the showcase.
Figure 5:
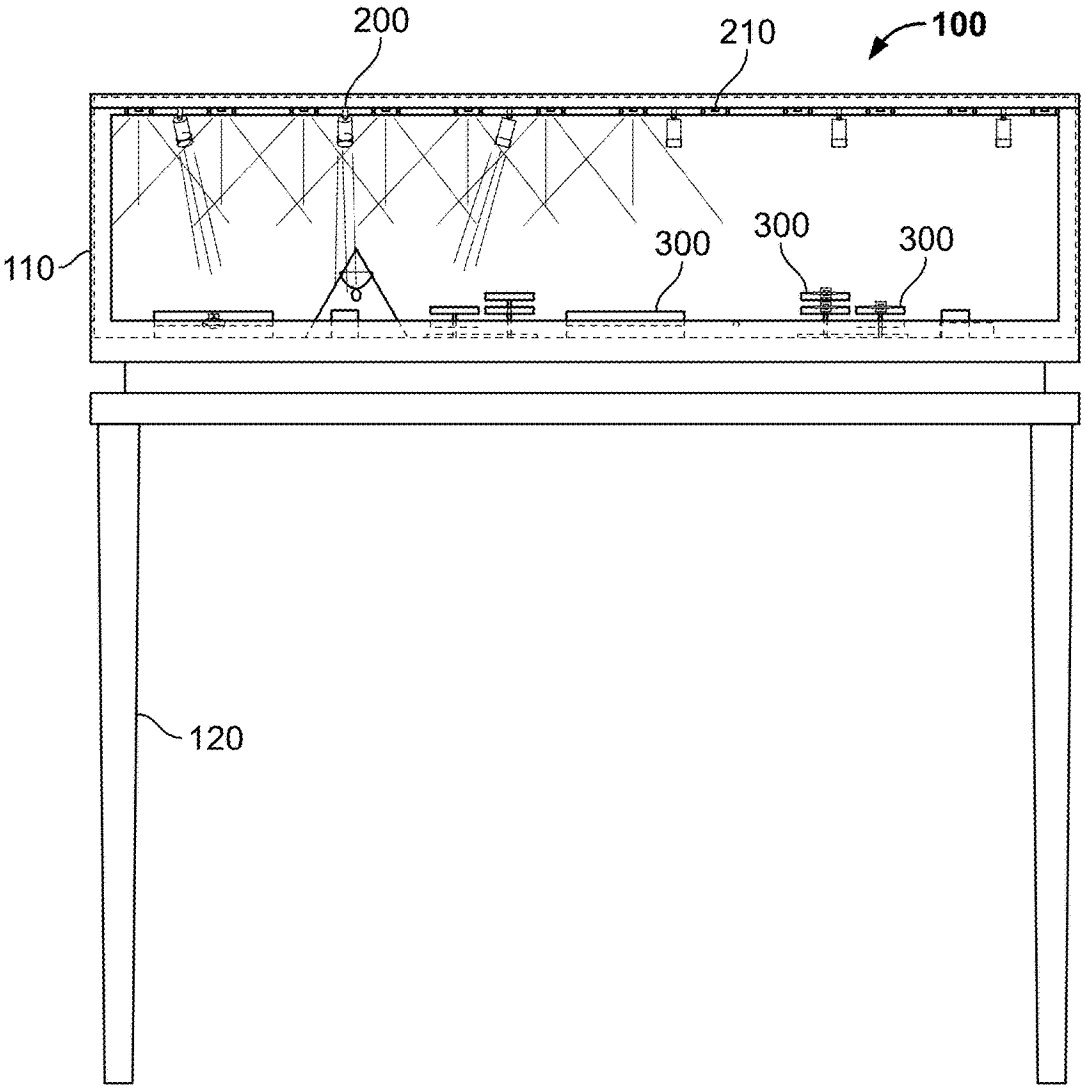
FIG. 5 is a side view of the showcase.
Figure 9:
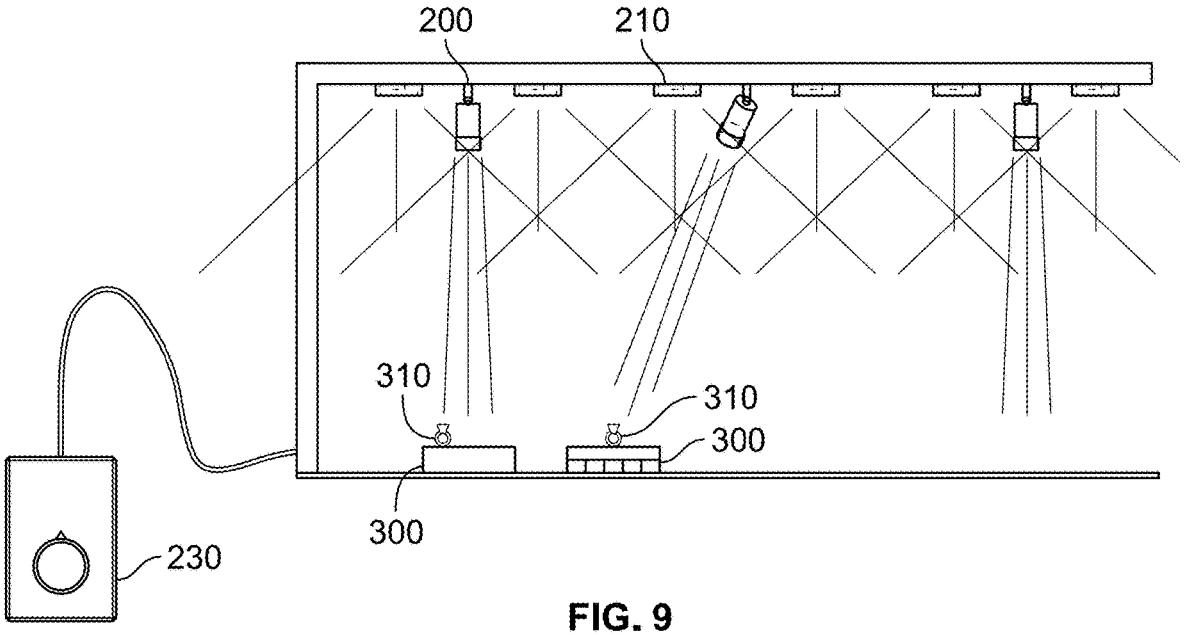
FIG. 9 is a simplified front view showing the showcase lighting with items (full showcase not shown—and beams of white light are illustrated (visible) and (invisible) radiation of UV LEDs is illustrated (as though it were visible) in order to show possible pathways.

Attached to the circuit 206, and secured to form an overall compact assembly 200, is an optical collimator 209. Using a parabolic lens 209, the optical collimator receives and narrows the UV radiation beam emitted by the UV LED. The path of this collimated beam is best seen in FIGS. 5, 6 and 9.

In the energized state, the LED emits a beam of UV radiation that is collimated and focussed (at an angle of less than 15°, and more preferably no more than 8-10° to directly strike the ultraviolet-reactive item. The housing 202 of the UV LED assembly also preferably allows for directional adjustment (manual or automated) so that the emitted UV can be positioned to strike primarily or only the intended target (the UV-reactive item) avoiding other surfaces of the showcase or internal mountings, or even other non-reactive parts of the item (e.g. unpainted surfaces of a UV-reactive painted item). UV radiation can have a destructive effect over time on many materials.

The invisible UV energy is in watts (here, preferably at least 3 watts), a radiometric output (i.e. the intensity of power output). The energy becomes visible fluorescence emitted by the item, as illustrated in FIG. 11. The fluorescent light emitted by the item 310 (in FIG. 11 shown as a gemstone) is a form of photometric output, which is typically measured in lumens depending on how bright the light appears to the human observer.

When using high-intensity ultraviolet diodes, there is a concern for thermal management. UV LEDs create more heat than LEDs of other wavelengths. Accordingly, a passive heat sink 204 may be provided in direct physical communication with the LED circuit 206 to dissipate heat from the diode. Alternatively, a programmable chipset (not shown) may be used to manage temperature through a feedback process of converting heat as it is created to more emitted energy. Within the context of the showcase, natural thermal management is also provided simply by air convection. Although not necessary in most instances, venting may also be provided in the showcase for heat escape.

The power may be provided by AC line voltage to an integrated low voltage transformer. In one embodiment, the system may be battery powered. Lithium ion cells of at least approximately 1000 mAh may be used to provide sufficient power for the high-powered diodes.

By wiring the white light assembly and UV LED assembly together with a common controller, modulation can be provided. The modulation enables sufficient lumen output from the UV to stimulate fluorescence to such a degree that it will show through and be visible in a fantastic way even in the presence of white light.

The wiring may run through channels in the showcase (or outside the showcase with lighting directed into the case). It may be provided in a kit form that may be placed into an existing showcase.

No particular dimensional limitations are intended. However, it will be appreciated that there is a decay over distance of the UV radiation. Therefore, at greater distances from the item to be stimulated, the power of the UV LED must also be greater.

Although the present invention has been disclosed with reference to specific forms and embodiments, it will be evident that a great number of variations may be made without departing from the spirit and scope of the present invention. For example, equivalent elements may be substituted for those specifically disclosed and certain features of the present invention may be used independently of other features—all without departing from the present invention as defined in the appended claims.

The invention claimed is:

1. A showcase for displaying items, at least one of which is an ultraviolet-reactive item, the showcase comprising:

a showcase structure comprising an enclosure for containing the items to be displayed, the enclosure defined by multiple glazed walls through which the items can be seen from different vantage points;

showcase lighting hidden within and wired with the showcase structure, including:

at least one compact ultraviolet LED assembly having a housing, within which is disposed an LED circuit, a 365 nm ultraviolet LED diode disposed on the LED circuit, and an optical collimator having a parabolic lens to focus the emitted ultraviolet radiation;

a white light assembly capable of outputting white light in a range of colour temperature from 2800K to 5500K; and a controller for controlling the ultraviolet LED assembly and white light assembly with modulation such that the ultraviolet LED stimulates visible fluorescence in the ultraviolet-reactive item while items in the showcase structure are simultaneously broadly illuminated by the white light;

wherein, from at least one vantage point, the ultraviolet-reactive items in illuminated and excited state are visible within the enclosure, while the showcase lighting is not.

2. The showcase of claim 1, wherein the housing of the at least one ultraviolet LED assembly is adjustable so that its emitted LED radiation can be positioned toward at least one ultraviolet-reactive item.

3. The showcase of claim 2, wherein the housings of multiple ultraviolet LED assemblies are differently adjustable, so as to either converge their respective emitted LED radiation toward a single ultraviolet-reactive item, or to be directed toward separate ultraviolet-reactive items.

4. The showcase of claim 2, further comprising display mountings disposed within the showcase structure.

5. The showcase of claim 4, wherein the housing of the at least one ultraviolet LED assembly is adjustable so that its emitted LED radiation can be positioned toward an ultraviolet-reactive item on at least one of the mountings.

6. The showcase of claim 5, wherein the ultraviolet radiation is collimated to hit the ultraviolet-reactive item substantially without hitting the at least one mounting.

7. The showcase of claim 1, wherein the showcase lighting is wired through a channel in the showcase structure.

8. The showcase of claim 1, wherein the showcase lighting is removably wired through a channel in the showcase structure.

9. The showcase of claim 1, wherein the controller is programmable to selectively modulate power output of the ultraviolet LED assembly and the white light assembly.

10. The showcase of claim 1, wherein the controller is programmable to power the ultraviolet LED assembly and the white light assembly on a timed basis.

11. The showcase of claim 1, wherein the controller is programmable to power the ultraviolet LED assembly and the white light assembly on a patterned basis.

12. The showcase of claim 1, wherein at least one of the assemblies is on a pendant.

13. The showcase of claim 1, wherein the collimator focusses the emitted ultraviolet radiation to a less than 15 degree spread.

14. The showcase of claim 1, wherein the collimator focusses the emitted ultraviolet radiation to a 0-10 degree spread.

15. The showcase of claim 1, wherein the ultraviolet LED assembly and the white light assembly are wired on a common circuit.

16. The showcase of claim 1, wherein the showcase structure has a door or window or gate through which items can be inserted and positioned in the path of the ultraviolet radiation of one or more of the ultraviolet LED assemblies.

17. A method for displaying items in a showcase, comprising:

providing a showcase structure comprising an enclosure for containing items to be displayed, the enclosure defined by multiple glazed walls through which the items can be seen from different vantage points;

providing showcase lighting by wiring the showcase lighting so that it is hidden within the showcase structure, the showcase lighting including:

at least one compact ultraviolet LED assembly having a housing, within which is disposed an LED circuit, a 365 nm ultraviolet LED diode disposed on the LED circuit, and an optical collimator having a parabolic lens to focus the emitted ultraviolet radiation;

a white light assembly capable of outputting white light in a range of colour temperature from 2800K to 5500K; and a controller for controlling the ultraviolet LED assembly and white light assembly with modulation;

inserting in the showcase structure the items to be displayed, wherein at least one of the items is an ultraviolet-reactive item; and either positioning the ultraviolet-reactive item such that it is in a path of the emitted ultraviolet radiation of the ultraviolet LED assembly, or directing the housing of the ultraviolet LED assembly such that its emitted ultraviolet radiation is directed toward the ultraviolet-reactive item;

wherein the ultraviolet LED stimulates visible fluorescence in the ultraviolet-reactive item while items in the showcase structure are simultaneously broadly illuminated by the white light; and wherein, from at least one vantage point, the ultraviolet-reactive items in illuminated and excited state are visible within the enclosure, while the showcase lighting is not.

18. A kit for retrofitting a showcase to display both ultraviolet-reactive and non-ultraviolet reactive items, the showcase having a showcase structure comprising an enclosure defined by multiple glazed walls through which the items can be seen from different vantage points, the kit comprising:

an assembly for wiring into the showcase structure so that it is hidden, the assembly including:

at least one compact ultraviolet LED assembly having a housing mountable on or in the showcase structure, within which is disposed an LED circuit, a 365 nm ultraviolet LED diode disposed on the LED circuit, and an optical collimator having a parabolic lens to focus the emitted ultraviolet radiation;

a white light assembly mountable on or in the showcase structure and capable of outputting white light in a range of colour temperature from 2800K to 5500K; and a controller in communication with the ultraviolet LED assembly and the white light assembly for controlling the ultraviolet LED assembly and the white light assembly for controlling the ultraviolet LED assembly and the white light assembly with modulation such that the ultraviolet LED stimulates visible fluorescence in the ultraviolet-reactive item while all items in the showcase structure, both ultraviolet-reactive and non-ultraviolet reactive, are simultaneously broadly illuminated by the white light;

the assembly being sized and shaped for hiding in the showcase structure such that, after having been installed in the showcase structure, to an observer from at least one vantage point, the items in illuminated and excited state are visible within the enclosure while the assembly is not.

19. The showcase of claim 1, wherein the controller is configured for controlling the ultraviolet LED assembly and white light assembly with modulation, such that the collimated UV light of the ultraviolet LED stimulates visible fluorescence in the ultraviolet-reactive item while items in the showcase structure, including the ultraviolet-reactive item, are simultaneously broadly illuminated by the white light.

* * * * *